United States Patent [19]

Hasegawa et al.

[11] 4,427,458

[45] Jan. 24, 1984

[54] METHOD FOR FORMING PROTECTIVE SURFACE FILM ON ALUMINUM SHAPED ARTICLES

[75] Inventors: Akira Hasegawa, Kurobe; Koichi Tanikawa, Nyuzen, both of Japan

[73] Assignee: Yoshida Kogyo K. K., Tokyo, Japan

[21] Appl. No.: 324,104

[22] Filed: Nov. 23, 1981

[30] Foreign Application Priority Data

Dec. 1, 1980 [JP] Japan ..... 55-168033
Dec. 1, 1980 [JP] Japan ..... 55-168034

[51] Int. Cl.[3] ..... C23F 7/14; C23F 7/26

[52] U.S. Cl. ..... 148/6.15 R; 148/6.2; 148/6.27

[58] Field of Search ..... 148/6.2, 6.27, 6.15 R

[56] References Cited

U.S. PATENT DOCUMENTS 3,285,788 11/1966 Svadlenak ..... 148/6.2
3,331,710 7/1967 Lodeesen ..... 148/6.2

FOREIGN PATENT DOCUMENTS 650082 10/1962 Canada ..... 148/6.2

OTHER PUBLICATIONS

Metal Finishing, Aug. 1966, vol. 64, #8, pp. 50–57, Pearlstein.

*Primary Examiner*—Sam Silverberg
*Attorney, Agent, or Firm*—Hill, Van Santen, Steadman & Simpson

[57] ABSTRACT

The invention provides a novel method for non-electrolytically forming a protective film on the surface of a shaped article made of aluminum or an aluminum-based alloy having high durability in respect of corrosion resistance and light resistance. The method is particularly suitable for the surface treatment of aluminum-made fastener elements of a slide fastener chain fastened to the fastener tape along the periphery thereof. The inventive method comprises the steps of cleaning the surface of the aluminum article, e.g. by degreasing and rinsing with water, chemical conversion treatment of the article in a treatment solution to form a conversion film on the surface, removal of the treatment solution from the surface of the article as completely as possible and heating the article at a temperature in the range from 90° to 150° C., preferably, for 3 to 9 minutes to increase the stability and to strengthen the adhesion of the conversion coating film on the surface of the article.

3 Claims, No Drawings

METHOD FOR FORMING PROTECTIVE SURFACE FILM ON ALUMINUM SHAPED ARTICLES

BACKGROUND OF THE INVENTION

The present invention relates to a method for forming a protective surface film on an aluminum shaped article by a non-electrolytic chemical means. The protective surface film formed according to the inventive method is very durable with good adhesion to the aluminum base and also imparted with excellent light resistance. The method is particularly suitable for the treatment of aluminum-made elements in slide fastener chains.

As is well known, shaped articles of metallic aluminum or an aluminum-based alloy (hereinafter referred to merely as aluminum) are rarely used as shaped but used after being provided with a surface film with objects not only to enhance the mechanical and chemical resistance but also to improve beautifulness. Such a protecting surface film on aluminum shaped articles is obtained either by an electrolytic method of anodization or by a non-electrolytic method of chemical conversion by use of certain chemicals. These methods have their own advantages and disadvantages. For example, an aluminum shaped article provided with a protective surface film by the anodization is very excellently resistant against corrosion so that surface treatment of most of aluminum-made building materials such as wall panels and window sashes is performed by this electrolytic method. A disadvantage of the anodization method is, on the other hand, the relatively poor fastness of color when the surface-anodized aluminum article is subjected to coloring to increase beautifulness in addition to the high costs required for the expensive electrolytic facilities.

The method of chemical conversion coating is preferred because, despite the outstanding simplicity and low costs of the treatment process owing to the absence of the complicated electrolytic treatment in the expensive facilities, the surface film obtained by the method is sufficiently corrosion-resistant and remarkably beautiful although the anti-abrasion resistance of the surface film formed by the method is somewhat inferior to that obtained by the anodization. When the aluminum article is finished by providing an overcoating with a coating composition, e.g. paints and varnishes, poor anti-abrasion resistance is less significant so that the chemical conversion method is widely practiced as a method of pre-treatment for the overcoating.

Turning now to the slide fastener chain having a plurality of elements fastened to a tape material along a periphery thereof at a regular interval, the elements are made either of a metal or a plastic synthetic resin. As a metal for shaping the fastener elements, brass, red brass and aluminum are the usually used materials. The former two materials are advantageously excellent in the anti-abrasion resistance while disadvantageous in the expensiveness on the other hand. The fastener elements made of aluminum or an aluminum-based alloy are relatively inexpensive but certain problems must be overcome when coloring of the elements is desired.

The coloring of fastener elements is conventionally undertaken either by coating with a paint or by the anodization treatment followed by dyeing of the anodized surface film in a dye solution.

The coloring in the former method is obtained by the mere adhesion of the colored coating layer to the aluminum base so that the largest problem in this method is the poor durability of the coating layer which is susceptible to wearing off or exfoliation by the repeated contact of the elements with the slider of the fastener chain or by the repeated laundering of the clothes and the like to which the slide fastener is attached.

The latter method of the anodization and dyeing is preferable in respect of the durability or anti-abrasion resistance of the colored surface when the high costs for the electrolytic treatment can be disregarded caused by the large investment for the electrolytic facilities. The most serious problem, on the other hand, is the poorly uniform electrolytic conditions for each of the fastener elements fastened in a fastener tape. This problem is unavoidable as a natural consequence of the electrolytic treatment of such a large number of fastener elements since the effects of anodization and dyeing can never be uniform unless the uniformity is ensured in the electrolytic conditions for each of the elements.

In the prior art, the uniformity in the electrolytic conditions for the elements is obtained only by providing a lead wire interwoven to the fastener tape along the peripheral portion thereof to which the elements are fastened and contacting the elements with the lead wire. Such a lead wire interwoven to the fastener tape naturally results in decreased flexibility of the slide fastener chain so that the clothers and the like with such a slide fastener chain attached thereto sometimes exhibit awkward appearance with waving or bulging in addition to the decreased smoothness in the running of the slider along the row of the elements.

Another problem in the method of anodization and dyeing of the fastener elements fastened to a fastener tape is that the tape is also dyed in the dyeing solution to cause undesired coloring of the tape simultaneously with the elements. The thus dyed tape cannot resume its original color even by careful washing, especially, when the tape is of white or light color so that the applicability of the method is limited to the fastener chains with deep-colored tapes.

A further problem in common to both of the former and the latter methods is the poor light resistance of the colored surface of the fastener elements resulting in less pleasant appearance with faded color after a relatively short period of use.

SUMMARY OF THE INVENTION

It is therefore an object of the present invention to provide a method for forming a protective surface film on an aluminum shaped article by the non-electrolytic chemical conversion method in view of the simplicity of the method, according to which the protective surface film is imparted with remarkable anti-abrasion resistance and light resistance to give a solution of the problems in the prior art method of chemical conversion coating.

Another specific object of the present invention is to provide a novel and improved method for providing colored protective surface film on the aluminum-made fastener elements fastened to a fastener tape along the periphery thereof by the method of chemical conversion coating.

The method of the invention for providing a protective surface film on an aluminum shaped article comprises the steps of:

(a) cleaning the surface of the aluminum shaped article by, for example, degreasing and rinsing;

(b) bringing the thus cleaned surface of the aluminum shaped article into contact with a treatment solution capable of forming a chemical conversion coating film on the surface of the article;

(c) removing the treatment solution from the wet surface of the aluminum article as completely as possible without heating; and (d) heating the aluminum shaped article at a temperature in the range from 90° to 150° C.

The above described process of the inventive method is of course applicable to any kind of aluminum shaped articles. When the method is applied to the treatment of slide fastener elements fastened to the fastener tape along the periphery thereof and a plurality of fastener chains are treated in one time, in particular, it is preferable that the chemical conversion in the treatment solution is carried out in two steps with an intermediate step of tension control of the fastener chains so as to minimize the unevenness in the effect of treatment due to the decreased uniformity in the tension of the individual tapes caused in the treatment solution.

DETAILED DESCRIPTION OF THE PREFERRED EMBODIMENTS

The first step in the inventive method is the cleaning of the surface of the aluminum shaped article. The principal object of cleaning is degreasing which can be effected by several known means including ultrasonic cleaning, alkali treatment, emulsion degreasing and the like. Completeness of degreasing is a key factor for the uniform formation of the chemical conversion coating film on the surface of the aluminum article. A recommended procedure for degreasing is that the aluminum article is dipped in a detergent solution in a vessel holding an ultrasonic generator so that completeness of degreasing is ensured by the cooperative effects of the detergent and the ultrasonic waves.

The degreasing as above in any way should be followed by rinsing with water to remove the detergent solution and the dirty matters formed in the degreasing and adhering to the aluminum surface. Powerful rinsing is performed, for example, by spraying wash water on to the aluminum surface or by dipping the aluminum article in the bath of the wash water. It is recommended that, before the thus cleaned aluminum article is transferred to the next step of chemical conversion treatment, any extraneous volume of the wash water wetting the aluminum surface be removed as far as possible by means of, for example, suction in order to prevent undue dilution of the treatment solution for the chemical conversion by the water brought thereinto together with the aluminum article under treatment.

The aluminum shaped article with the thus cleaned surface is then subjected to the chemical conversion treatment. The particular process of the chemical conversion treatment is not limitative and any one of known processes is suitable including the chromic acid process, phosphoric acid process, phosphoric acid-chromic acid process, sodium phosphate-chromic acid process, sodium carbonate process and the like. The first mentioned chromic acid process is performed by dipping the aluminum article in an aqueous solution containing 5 to 10% by weight of chromic acid at about 65° C. for 3 to 5 minutes and the second mentioned phosphoric acid process is performed by dipping the aluminum article in a solution prepared by mixing 1 part by weight of phosphoric acid and about 3 parts by weight of an alcohol such as methyl, propyl and butyl alcohols, usually, at room temperature for 5 to 30 minutes. The phosphoric acid-chromic acid process provides an improvement over the phosphoric acid process in respect of the anti-corrosion resistance of the treated aluminum surface by admixing chromic acid and a fluoride with the phosphoric acid-containing treatment solution as mentioned above. The sodium phosphate-chromic acid process is performed by first dipping the aluminum article in an aqueous solution containing 5 to 20% by weight of sodium phosphate and about 5% by weight of an alcohol at room temperature for about 5 minutes followed by dipping of the same in an aqueous solution containing about 5% by weight of chromic acid. Further, the sodium carbonate process is performed by dipping the aluminum article in an aqueous solution containing about 5% by weight of sodium carbonate at room temperature for about 20 to 30 minutes. According to the recipes of the treatment solutions and the details of the conditions, these methods are sometimes called by the names of Bonderite process, Bauer-Vogel process, Modified Bauer-Vogel process, Erstwerk process, pylumin process, Protal process, Alrok process, Jirotka process, Pacz process, Vereinigte Aluminium Werk process, Mcculloch Process, Albonde process, Alodine process, Iridite process and the like. In addition to the above, a process is known utilizing an aqueous solution of a strongly oxidizing agent such as potassium permanganate and the like.

Any one of the above described processes for the chemical conversion coating may be suitably applied to the aluminum article according to the particular object of the treatment without particular limitations except that, when the method is applied to the treatment of the slide fastener chain bearing the fastener elements on a fastener tape, care should be taken to avoid the chemical attack of the acidic, alkaline or strongly oxidizing treatment solution to the fibrous material of which the fastener tape is formed. For example, fastener tapes made of polyester fibers are relatively resistant against acidic treatment solutions while acidic treatment solutions should be avoided in the treatment of fastener chains with cotton-made fastener tapes taking into consideration the poor resistance of cotton against attack of acid solution.

When a plurality of slide fastener chains are subjected to the process of chemical conversion coating as described above, the treatment is preferably undertaken in two steps as is mentioned before with an intervening step of tension control therebetween. As is usually the case, the chemical conversion treatment of slide fastener chains is performed simultaneously in multiple lines for which more or less unbalanced tension is always unavoidable among the lines causing undesirable unevenness in the bias and lengths of the individual fastener chains. The step of tension control succeeding the first chemical conversion treatment can give a means for controlling the travelling velocity of each of the fastener chains so that uniformity in the quality of the finished products is ensured.

The surface of the aluminum shaped article is imparted with good corrosion resistance by the above described method of chemical conversion coating without the necessity of providing a means for electric power supply such as the lead wires indispensable in the anodization treatment of fastener elements fastened to the fastener tape so that the flexibility of the slide fastener chains is never decreased to ensure smoothness of the sliding movement of the slider along the row of the fastener elements.

The above described chemical conversion treatment is also suitable for imparting colored surface to the aluminum article when the treatment solution contains certain coloring or chromogenic ingredients according to need although even an aluminum article provided with the anti-corrosion surface film by the above mentioned chemical conversion treatment but without coloring may be sufficiently pleasant in appearance as a matter of taste. For example, a treatment solution containing chromic acid can give a beautiful aluminum surface colored in light yellow to brown while an aluminum surface beautifully colored in light green is obtained by the treatment in a treatment solution containing chromic acid and phosphoric acid.

At any rate, the adhesion of the protective suface film formed by the chemical conversion treatment as such is not sufficiently good and the anti-corrosion resistance and the light resistance thereof are also incomplete necessitating further treatments.

The next step following the above described step of chemical conversion coating is the removal of the treatment solution from the wet surface of the aluminum article which is most conveniently carried out by washing or rinsing with water. When the treatment of the chemical conversion is performed by use of a treatment solution containing chromic acid or a chromium salt, care should be taken to avoid possible problems of toxicity to human bodies and environmental pollution since hexavalent chromium is notoriously toxic. This step of the removal of the treatment solution may be performed by a suitable known method. When the aluminum article is the fastener element fastened to a fastener tape, in particular, washing with pressurized spray of water is preferred since the solution soaking the fastener tape may be removed by this technique as completely as desired. This condition of complete removal of the treatment solution is particularly important in the case of a white or light-colored fastener tape since otherwise the tape will be colored unevenly.

The aluminum article thus washed or rinsed with water is then dehydrated without heating as completely as possible before being subjected to the next step of heat treatment. In the case of the slide fastener chain, in particular, this removal of the wetting water is preferably carried out with suction at the reverse side of the fastener tape to that at which the wash water has been sprayed so as to further increase the completeness of the removal of the treatment solution and the efficiency of the dehydration. This step is very essential since direct heating of the aluminum article as wetted with water on the surface of the protective surface film formed in the chemical conversion treatment may adversely affect the surface film still in s fragile condition with poor adhesion to the aluminum base along with boiling of the water drop on the surface resulting in local damage to the coating film to give an unsatisfactory product with unevenly protected surface.

The last step in the inventive method is the heat treatment of the aluminum article. This treatment is important in order to improve the adhesion of the chemical conversion coating film to the surface of the aluminum base as well as to enhance the stability of the coating film. The heat treatment is carried out at a temperature in the range from 90° to 150° C. for a length of time, preferably, from 3 to 9 minutes in a hot-air oven or under infrared lamps. When the temperature is lower than 90° C., no sufficient improvement is obtained in the adhesion of the coating film to the surface of the aluminum base resulting in eventual exfoliation of the coating film off the finished aluminum article while the surface luster of the conversion coating film is greatly reduced by a heat treatment at a temperature higher than 150° C.

It is of course optional that the surface of the aluminum article is finally finished by any known method such as waxing, for example, to decrease the resistance against sliding of the slider along the row of the fastener elements.

In accordance with the inventive method, the aluminum shaped article can be provided with a very durable protective surface film on the surface in a very simple and convenient process and unexpectedly satisfactory results are obtained in that the thus formed conversion coating film is bonded to the surface of the aluminum base with very strong adhesion and imparted with excellent light resistance by the combination of the above described steps of the removal of the extraneous treatment solution from the surface thereof and the heat treatment.

Following are the examples to illustrate the method of the present invention in further detail.

EXAMPLE 1

An article shaped by extruding an A-5056W aluminum alloy is dipped in a detergent solution and complete degreasing was carried out with the cooperative effect of ultrasonic waves generated by the ultrasonic generator installed in the vessel. The thus degreased article was rinsed with water and dehydrated with suction.

The chemical conversion treatment of the thus cleaned aluminum article was performed by use of an aqueous solution containing 60 g/liter of Bonderite BT713M (tradename by Nippon Parkerizing Co.) to give a treatment solution containing 0.1% by weight of hydrogen fluoride, 0.25% by weight of chromic anhydride, 0.25% by weight of bichromic acid and 0.25% by weight of nitric acid, in which the aluminum article was dipped for 6 minutes at 50° C. The treatment solution was agitated throughout the treatment time by aeration.

After completion of the chemical conversion treatment, the aluminum article was taken out of the solution, rinsed completely with water, dehydrated with suction and heated in a hot-air oven at 120° C. for 6 minutes followed by polishing to give the finished product.

The thus finished aluminum article had a conversion coating film of about 0.3 μm thickness on the surface colored in beautiful golden yellow. This aluminum product was subjected to the tests of boiling in water, resistance against sea water and light resistance according to the procedures specified in JIS L 0842 to give the results shown in Table 1 below. Table 1 also includes the results obtained with the same aluminum articles finished by use of a paint or by the anodization treatment. The numerical values in the table indicate the proportion in % of the areas with faded color to the total surface area of the aluminum article.

As is clear from the results shown in the table, the inventive method was as effective as the anodization treatment in respect of the boiling test and the sea-water test and much higher light resistance was obtained than in the paint coating and anodization.

Meanwhile, coloring may be controlled by the adjustment of the concentration of the treatment solution as well as the temperature and time of the treatment even by the use of the same type of the solution.

TABLE 1

| Protective treatment | | Present invention | Coating with paint | Anodization |
|---|---|---|---|---|
| Boiling test | 60 minutes | 0 | 40 | 0 |
| | 120 minutes | 5 | 60 | 0 |
| Sea-water test | 3 days | 0 | 0 | 0 |
| | 5 days | 0 | 0 | 0 |
| Light resistance | 20 hours | 0 | 50 | 40 |
| | 60 hours | 0 | 80 | 100 |

For example, the golden yellow tone of coloring is best when the conversion treatment is performed with a solution containing 4 to 8% of Bonderite 713M at 40° to 60° C. for 4 to 8 minutes.

The method of the present invention is useful for the protective treatment of various kinds of building materials, housewares, machine parts and the like made of aluminum or an aluminum alloy on which beautiful protective surface film is desired with excellent anti-abrasion resistance and light resistance.

EXAMPLE 2

Slide fastener chains provided with a plurality of aluminum-made fastener elements fastened thereto were subjected to the chemical conversion treatment in just the same way as in Example 1 above in two steps with an intermediate tension control of the fastener chains.

The tests according to JIS L 0842 undertaken with the elements gave substantially the same results as shown in Table 1. The colored stain on the fastener tapes was very insignificant even when the fastener chain was white provided washing after the chemical conversion treatment was complete.

What is claimed is:

1. A method for non-electrolytically forming a protective film on the surface of a fastener element of a slide fastener chain made of aluminum or an aluminum based alloy and fastened to a fibrous fabric tape at the periphery thereof which comprises the steps of:

(a) cleaning the surface of the fastener element to effect degreasing thereof, (b) bringing the fastener element into contact with a treatment solution capable of forming a chemical conversion coating film on the surface of the fastener element;

(c) washing the treatment solution off the fastener element with a spray of wash water;

(d) applying suction to the fabric tape at the reverse side from which said wash water was applied to remove said wash water, and (e) heat treating the coated article at a temperature of from 90° to 150° C.

2. The method as claimed in claim 1 wherein the cleaning in the step (a) is performed be degreasing the surface of the fastener element followed by rinse with water.

3. The method as claimed in claim 1 wherein the heating in the step (d) is performed for 3 to 9 minutes.

* * * * *